United States Patent [19]

Weber et al.

[11] 4,418,506

[45] Dec. 6, 1983

[54] GLAZED WALL CONSTRUCTION SYSTEM

[75] Inventors: Ronald J. Weber; Lyon E. Evans, both of Wausau, Wis.

[73] Assignee: Wausau Metals Corporation, Wausau, Wis.

[21] Appl. No.: 182,866

[22] Filed: Sep. 2, 1980

[51] Int. Cl.[3] ..... E04B 2/88; E06B 7/14

[52] U.S. Cl. ..... 52/209; 52/235; 52/398; 52/400

[58] Field of Search ..... 49/DIG. 1, DIG. 2; 52/235, 400, 209, 282, 397, 463, 476, 395, 398, 302, 304

[56] References Cited

U.S. PATENT DOCUMENTS

| | | | |
|---|---|---|---|
| 2,985,263 | 5/1961 | Maciunas | 52/403 |
| 3,466,826 | 9/1969 | Gallagher et al. . | |
| 3,557,654 | 1/1971 | Weidner, Jr. . | |
| 3,618,444 | 11/1971 | Kay et al. . | |
| 3,693,495 | 9/1972 | Wagner . | |
| 3,844,087 | 10/1974 | Schultz et al. . | |
| 3,858,375 | 1/1975 | Silvernail . | |
| 3,866,374 | 2/1975 | Dallen | 52/235 |
| 4,114,330 | 9/1978 | Sukolics | 52/200 |
| 4,154,138 | 5/1979 | Melone | 411/373 |

FOREIGN PATENT DOCUMENTS

| | | | |
|---|---|---|---|
| 2432058 | 1/1976 | Fed. Rep. of Germany | 52/302 |

*Primary Examiner*—John E. Murtagh

*Attorney, Agent, or Firm*—Isaksen, Lathrop, Esch, Hart & Clark

[57] ABSTRACT

A glazed wall construction system is disclosed in which all the interior metallic structural elements of the wall system are thermally isolated from the exterior air and from all other metallic components which are in contact with the exterior air. This isolation is accomplished by a separator (56) which covers a boss (36) provided on the structural frame member (34) and by a special fastener (42) which has a non-metallic head (64) molded on it so that it can fasten an exterior cover (40) to the system without serving as a conduit for heat.

9 Claims, 5 Drawing Figures

GLAZED WALL CONSTRUCTION SYSTEM

TECHNICAL FIELD

The present invention relates to building construction systems in general and, in particular, to building construction systems for monolithic buildings in which the exterior of the building is formed by one or more wall panels held in spaced, side-by-side relation.

DESCRIPTION OF THE PRIOR ART

The prior art is generally cognizant of glazed wall construction systems for buildings, particularly for monolithic buildings, in which the exterior of the building is made up of a plurality of generally horizontal panels which are held in side-by-side relation within a frame structure attached to the sides of the building. Examples of such wall construction systems can be found in U.S. Pat. No. 3,466,826, No. 3,844,087, No. 3,858,375 and No. 3,866,374.

In many such glazed wall systems, it is found to be advantageous to isolate the interior metallic components of the frame structure of the system from cold air on the exterior of the building. Thus, for example, shown in FIG. 1 is one such prior art wall construction system. In the wall construction system of FIG. 1, a rectangular frame member 1 supports the panel wall structure and has formed on the front thereof a forwardly extending boss 2. The boss 2 extends between a respective pair of wall panels 3 and 4 which may be solid, opaque panels, but are most commonly double panes of glass. An exterior plate 5 is provided which is fastened by a bolt 6 to the boss 2. A non-structural spacer 7 arranged around the shaft of the fastener 6 isolates the boss 2 from the exterior plate 5. A pair of gaskets 8 are provided on the underside of the exterior plate 5 to hold the pair of wall panels 3 and 4 between the exterior cover 5 and a pair of gaskets 9 positioned on the frame member 1. An exterior weather cover 10 is provided to cover the exterior of the exterior plate 5 so as to protect it from the weather. In such a system, the exterior plate 5 and the exterior weather cover 10 are conventionally provided with holes, called weep holes, so as to provide a vent for weep channels formed on either side of the boss 2 between the boss 2 and the respective pair of wall panels 3 and 4. The weep channels and weep holes are provided so that condensing moisture can be directed out of the building structure. Air can circulate through the exterior weather cover 10 and the exterior plate 5 and into the weep channels wherein it can contact the boss 2 and the frame member 1. This air, which would be cold during the winter, robs heat from the frame member 1 and represents an inefficiency in the heat sealing system of a wall constructed in this fashion.

It is also known in the prior art that metallic sheet metal fasteners may be provided with plastic or resin coated heads for a variety of purposes. Thus, for example, several examples of fasteners with heads coated with thermoplastic moldings are shown in U.S. Pat. No. 3,557,654, No. 3,618,444, No. 3,693,495 and No. 4,154,138.

SUMMARY OF THE INVENTION

The present invention is summarized in that a wall construction system in which at least one wall panel is supported in place by a frame system, the frame system includes: a frame member for providing structural support for the frame system, the frame member being located behind the wall panels; a boss formed on the frame member extending forwardly adjacent to an edge of the wall panel, the boss having a receptacle formed in it; an exterior plate attached to the boss on the frame to hold the wall panel between the plate and the frame member, the exterior plate having at least one centrally located fastener hole formed in it and having eccentrically located weep holes formed in it, the exterior plate holding the wall panel against the frame member so as to define weep channels between the edges of the wall panel and the boss of the frame member; a threaded fastener extending through the fastener hole in the exterior plate and threaded into the receptacle in the boss to fasten the exterior plate to the frame member; and a separator formed of low-heat conductive material shaped so as to fit over the boss on the frame member, the separator being held between the exterior plate and the boss and completely covering the boss so that the boss and the frame member are thermally isolated from air and moisture in the weep channels.

It is an object of the present invention to provide a structural frame system for a glazed wall construction system in which all the interior metallic, structural components of the frame system are thermally isolated both from the exterior air and from all other metallic elements of the frame system which are in contact with the exterior air so as to lessen the heating demand of a building to save energy.

It is another object of the present invention to provide such a system having weep holes and weep channels in which the air and moisture in the weep channels is thermally isolated from the interior structural components of the frame system.

It is another object of the present invention to provide a fastener capable of fastening such a system together while also thermally isolating from each other the components which are fastened together.

Other objects, advantages, and features of the present invention will become apparent from the following specification when taken in conjunction with the accompanying drawings.

DETAILED DESCRIPTION OF THE PREFERRED EMBODIMENT

Figure 1:
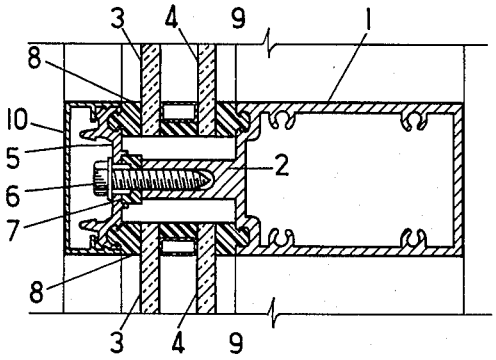
FIG. 1 PRIOR ART
FIG. 1 is a cross-sectional view of a structural frame system for a wall construction system constructed in accordance with a teaching of the prior art.
Figure 2:
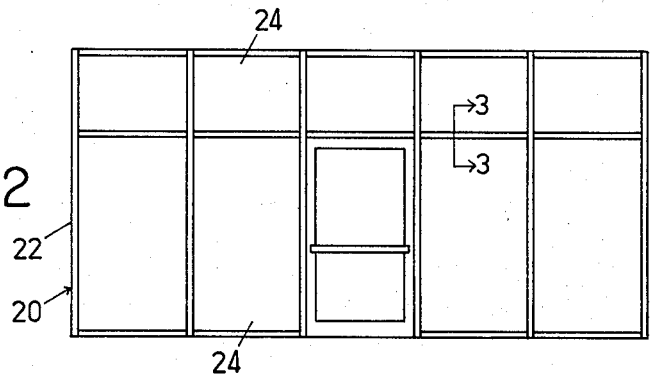
FIG. 2 is an elevational plan view of a wall constructed in accordance with the wall construction system of the present invention.

Shown in FIG. 2 is a wall constructed with a glazed wall construction system in accordance with the present invention. The glazed wall construction, which is generally indicated at 20, includes a structural frame system 22 designed to hold in place a plurality of wall panels 24 of varying size. While normally a glazed wall construction will include a large number of wall panels 24, some installations may require as few as one single wall panel 24.

Figure 3:
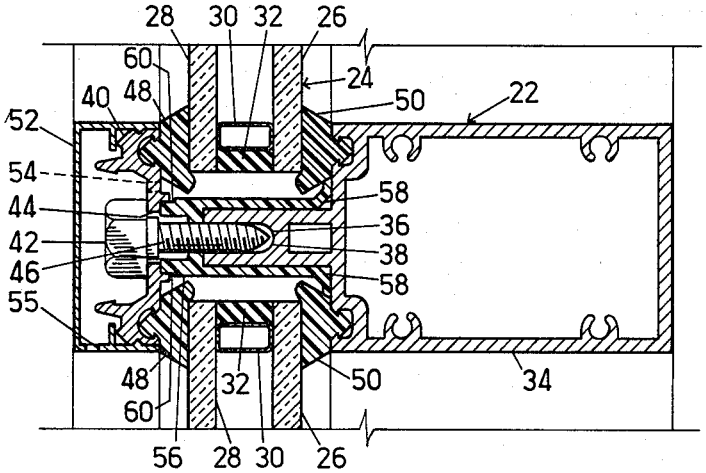
FIG. 3 is a cross-sectional view taken along the line 3—3 of FIG. 2.

Shown in FIG. 3 is a cross-sectional view of a typical portion of the wall system 20 of FIG. 2. The frame system, generally indicated at 22, includes components designed to hold in place the panels, generally indicated at 24. It is to be understood that the panels 24 may be any conventional kind of opaque, translucent or transparent panels, but are preferably transparent panels formed of respective pairs of double pane glass sheets 26 and 28 held in spaced relation from each other by spacers 30 which are sealed on their exterior by water tight seals 32.

The structural frame system 22 includes as its primary structural component a frame member 34. The frame member 34, which is preferably extruded of aluminum or other rigid metal, is attached to the interior of the building and serves to carry the remaining components of the wall construction system. The frame member 34 is an elongated extrusion which may be unitary, as shown in FIG. 3, or may be made up of two or more components and which may have additional specialized structure at edges, doors, or other special structures. The frame member 34 is located behind the adjacent pair of wall panels 24 and, more particularly, is positioned behind the adjacent side edges of the two wall panels 24. A boss 36 is formed on the front of the frame member 34 and extends forwardly from the frame member 34 between the edges of the adjacent wall panels 24. The boss 36 has a receptacle 38 formed in it extending from its forwardmost edge rearwardly into the center of the boss 36. An exterior plate 40, also preferably formed as an extrusion of aluminum or other metal, is fastened to the exterior of the structural frame system. A fastener 42 extends through a hole 44 located in the center of the exterior plate 40 and the fastener 42, which includes a threaded shaft 46, is threaded into the receptacle 38 formed in the boss 36 to attach the exterior plate 40 to the frame member 34. A pair of compressible gaskets 48 are compressed between the exterior plate 40 and the exterior sheet of glass 28, while a second pair of gaskets 50 are compressed between the interior sheet of glass 26 and the frame member 34. An exterior weather cover 52 is pressed over the exterior face of the exterior plate 40 for cosmetic purposes and to seal the unit from the weather. A series of weep holes 54 and 55 are provided in the exterior plate 40 and exterior weather cover 10 respectively to allow air flow from the exterior to the weep channels defined between the boss 36 and the edges of the glass sheets 26 and 28.

Held between the exterior plate 40 and the boss 36 of the frame member 34 is a separator 56. The separator 56 is formed of low-heat conductive material, such as rigid vinyl, and is shaped so as to fit over and completely cover the boss 36 on the frame member 34. The separator 56 includes a pair of legs 58 which are sized and shaped so as to extend along the exterior surface of the boss 36 to completely cover the boss 36 and which are turned outwardly at their extreme ends so as to cover the front of the frame member 34 adjacent to the boss 36 and to contact the gaskets 50 as can be seen in FIG. 3. The separator 56 is pierced by the point of fastener 42 so as to allow the threaded shaft 46 of the fastener 42 to pass therethrough. The separator 56 is further provided with a pair of projections 60 which extend forwardly in a direction opposite the legs 58 so as to contact the rearward surface of the exterior plate 40 to properly space the exterior plate 40 from the boss 36.

Figure 4:
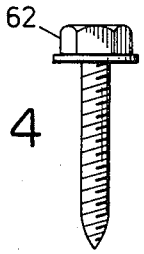
FIG. 4 is a perspective view of a conventional threaded fastener from which the threaded fastener used in the present invention is constructed.
Figure 5:
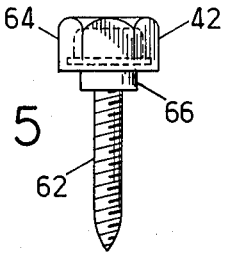
FIG. 5 is a perspective view of a threaded fastener constructed in accordance with the present invention.

Shown in FIGS. 4 and 5 are details of the threaded fastener 42 for use in the wall construction of FIG. 3. Shown in FIG. 4 is a fastener 62 from which the fastener 42 of the present invention is constructed. The fastener 62 is a conventional stainless steel sheet metal screw having a hexagonal head with a washer secured to it and a threaded shaft thereon tapering to a point. Shown in FIG. 5 is the threaded fastener 42 used in the present invention, which includes the fastener 62 having a molded head 64 molded about the head thereof. The molded head 64, which is formed of rigid, low-heat conductive material, such as glass-filled nylon, is formed about the head of the fastener 62 and includes a hexagonal portion, larger in size than the hexagonal head of the fastener 62 and a pilot shaft 66 extending slightly downwardly underneath the head 64 along the shaft of the fastener 62. Thus, the fastener 42 includes a conventional sheet metal fastener 62 with an extra covering provided around its head and the washer so as to thermally isolate the shaft and body of the fastener 62 from air which might contact the head of the completed fastener 42.

In its operation, the wall construction system in accordance with the present invention is particularly designed to thermally isolate the interior and structural components of the wall construction system from exterior air and moisture. Thus, it can be seen, by referring to FIG. 3, that none of the structural components of the system, such as the frame member 34 and the boss 36, are in any way in contact with any of the metallic members of the frame system which are in contact with the exterior air. In addition, the frame member 34 and the boss 36 are also completely thermally isolated from the weep channels formed on either side of the boss 36. This separation is primarily accomplished by the separator 56 which serves as a thermal barrier between the boss 36 and the exterior cover 40 and the weep channels. This isolation is further enhanced by the use of the fastener 42 which includes the molded portion about its head so that the central metallic core of the fastener 42 does not contact the exterior air and also does not contact the exterior cover 40 which may be cold because of its contact with the exterior air.

As stated, the separator 56 serves to isolate the boss 36 from the exterior cover 40. The separator 56 also, however, serves to isolate the boss 36 from air and moisture which may pass through the weep channels formed between the boss 36 and the side edges of the panels 24. These weep channels, which have access to exterior air through the weep holes 54, can become quite cold. The provision for the legs 58 on the separator 56, which extend rearwardly over the full extent of the boss 36 and which also cover the front edges of the frame member 34, serve to completely isolate air in the weep channels from all of the metallic elements of the frame member 34 and the boss 36. Free air and moisture passage is maintained, nevertheless, even though the likelihood of condensation is reduced since the outside air cannot contact any unprotected metallic components in the building.

The fastener 42 serves particularly to ensure that outside air does not contact any of the metallic elements which are, in turn, in firm contact with the interior elements of the wall system in accordance with the present invention. Thus, for example, the sheet metal fastener 62 at the center of the fastener 42 must be in contact with the boss 36 since it is threaded into the receptacle 38 formed therein. However, the metal elements at the center of the fastener 42 are not in contact with the exterior air because of the molded head 64 provided about the head of the fastener 42. Were it not for this provision, the fastener could serve as a heat-conducting conduit to conduct heat out of the building. Furthermore, the pilot shaft 66 formed underneath the head 64 ensures that the metal fastener 62 at the core of the fastener 42 is also not in contact with the exterior plate 40, which is in contact with the exterior air, as it passes through the hole 44 in the plate 40. Thus all of the metallic, heat-conductive elements of the wall construction system as shown in FIG. 3 are completely isolated from both the exterior air and from any other metallic, heat-conductive portions of the system which must be in contact with the exterior air.

While the details of the wall construction system in accordance with the present invention are shown in greatest detail in FIG. 3 with reference to a horizontal structural member as it fits into the wall construction system 20 shown in FIG. 2, it is to be understood that the exact construction of the frame member 34 and the exterior plate 40 may vary within the wall construction 20. Thus, for example, the frame member 34 and the exterior cover 40 may have to be shaped differently for vertical components as well as for components at the edge of the wall construction in which a panel is to be held on only one side of the frame member 34. Similar variations must be made in the design of the frame member and the exterior cover wherein doors or other movable openings in the wall construction system are provided. It is believed that such variations are conventional in the art and that the disclosure of FIG. 3 is sufficient to enable one skilled in the art to manufacture all elements of the wall construction system 20 at FIG. 2 in such a manner so as to completely and thermally isolate all of the interior structural elements, such as the frame members 34, from both the exterior air and all of the metallic elements in contact with the exterior air, such as the exterior plate 40.

It is to be understood that the present invention is not limited to the particular construction arrangements of parts disclosed and illustrated herein, but embraces all such modified forms thereof as come within the scope of the following claims.

I claim:

1. In a wall construction system including a plurality of wall panels (24) supported in place by a frame system (22), the frame system (22) comprising:

a frame member (34) for providing structural support for the frame system, the frame member (34) being located behind the wall panels (24);

a boss (36) formed on the frame member (34) extending forwardly between a pair of adjacent wall panels (24), the boss (36) having a receptacle (38) formed in it;

an exterior plate (40) attached to the boss (36) on the frame member (34) to hold the wall panels (24) between the plate (40) and the frame member (34), the exterior plate (40) having at least one centrally located fastener hole (44) formed in it;

a separator (56) interposed between the boss (36) on the frame member (34) and the exterior plate (40), the separator (56) formed of low-heat conductive material to thermally separate the exterior plate (40) and the frame member (34); and a threaded fastener (42) formed of a metallic sheet metal threaded fastener (62) having an enlarged head (64) molded on it from low-heat conductive material, the molded head (64) including a pilot shaft (66) extending downwardly therefrom, the fastener (62) extending through the respective holes in the exterior plate (40) and the separator (56) to fasten the exterior plate (40) to the frame member (34) while the molded head (64) of the fastener (42) thermally isolates the frame member (34) from both the exterior air and the exterior plate (40).

2. In a wall construction system, the frame system as claimed in claim 1 wherein the molded head (64) on the fastener (42) is formed of nylon.

3. In a wall construction system, the frame system as claimed in claim 1 wherein the exterior plate (40) has a plurality of weep holes (54) eccentrically positioned in it, the exterior plate (40) holding the wall panels (24) against the frame member (34) in such a fashion that weep channels are defined between the edges of the wall panels (24) and the boss (36), and wherein the separator (56) extends completely over the boss (36) to thermally isolate the boss (36) and the frame member (34) from air in the weep channels.

4. In a wall construction system including at least one wall panel (24) supported in place by a frame system (22), the frame system (22) comprising:

a frame member (34) for providing structural support for the frame system (22), the frame member (34) being located behind the wall panel (24);

a boss (36) formed on the frame member (34) extending forwardly to an edge of the adjacent wall panel (24), the boss (36) having a receptacle (38) formed in it;

an exterior plate (40) attached to the boss 36 on the frame member (34) to hold the wall panel (24) between the plate (40) and the frame member (34), exterior plate (40) having at least one centrally located fastener hole (44) and weep holes (54) formed in it, the exterior plate (40) holding the wall panel (24) against the frame member (34) so as to define weep channels between the edges of the wall panel (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34), the threaded fastener (42) provided with a molded covering about its head (64) of low-heat conductive material so that it does not serve to conduct heat from the boss (36) to the exterior air; and a separator (56) formed of low-heat conductive material shaped so as to fit over the boss (36) on the frame member (34), the separator (56) being held between the exterior plate (40) and the boss (36) and completely covering the boss (36) so that the boss (36) and the frame member (34) are thermally isolated from air and moisture in the weep channels.

5. A frame system (22) for a wall construction system including a plurality of wall panels (24) supported in place by the frame system (22), the frame system (22) comprising:

a frame member (34) for providing structural support for the frame system (22), the frame member (34) being located behind the position of the wall panels (24);

a boss (36) formed on the frame member (34) and extending forwardly therefrom, the boss (36) having a receptacle (38) formed in it;

an exterior plate (40) attached to the boss (36) on the frame member (34) to hold a wall panel (24) between the plate (40) and the frame member (34) on either side of the boss (36), the exterior plate (40) having at least one centrally located fastener hole (44) formed in it and having eccentrically located weep holes (54) formed in it, the exterior plate (40) being adapted to hold the wall panels (24) against the frame member (34) so as to define weep channels between the edges of the wall panels (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34), the threaded fastener (42) provided with a molded covering about its head (64) of low-heat conductive material so that it does not serve to conduct heat from the boss (36) to the exterior air; and a separator (56) formed of low-heat conducting material shaped so as to fit over the boss (36) on the frame member (34), the separator (56) being adapted to be held between the exterior plate (40) and the boss (36) and completely covering the boss (36) so that the boss (36) and the frame member (34) are thermally isolated from air and moisture in the weep channels.

6. In a wall construction system including at least one wall panel (24) supported in place by a frame system (22), the frame system (22) comprising:

a frame member (34) for providing structural support for the frame system (22), the frame member (34) being located behind the wall panel (24);

a boss (36) formed on the frame member (34) extending forwardly to an edge of the adjacent wall panel (24), the boss (36) having a receptacle (38) formed in it;

an exterior plate (40) attached to the boss 36 on the frame member (34) to hold the wall panel (24) between the plate (40) and the frame member (34), the exterior plate (40) having at least one centrally located fastener hole (44) and weep holes (54) formed in it, the exterior plate (40) holding the wall panel (24) against the frame member (34) so as to define weep channels between the edges of the wall panel (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34), the threaded fastener (42) provided with a molded covering about its head (64) of low-heat conductive material so that it does not serve to conduct heat from the boss (36) to the exterior air, the molded head (64) also including a pilot shaft (66) extending down the shaft of the fastener (42) so that the metallic shaft of the fastener (42) is not in contact with the exterior plate (40) as it passes through the hole (44) in the plate (40); and a separator (56) formed of low-heat conductive material shaped so as to fit over the boss (36) on the frame member (34), the separator (56) being held between the exterior plate (40) and the boss (36) and completely covering the boss (36) so that the boss (36) and the frame member (34) are thermally isolated from air and moisture in the weep channels.

7. In a wall construction system including at least one wall panel (24) supported in place by a frame system (22), the frame system (22) comprising:

a frame member (34) for providing structural support for the frame system (22), the frame member (34) being located behind the wall panel (24);

a boss (36) formed on the frame member (34) extending forwardly to an edge of the adjacent wall panel (24), the boss (36) having a receptacle (38) formed in it;

an exterior plate (40) attached to the boss 36 on the frame member (34) to hold the wall panel (24) between the plate (40) and the frame member (34), the exterior plate (40) having at least one centrally located fastener hole (44) and weep holes (54) formed in it, the exterior plate (40) holding the wall panel (24) against the frame member (34) so as to define weep channels between the edges of the wall panel (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34); and a separator (56) formed of low-heat conductive material shaped so as to fit over the boss (36) on the frame member (34), the separator (56) being held between the exterior plate (40) and the boss (36) and completely covering the boss (36) so that the boss (36) and the frame member (34) are thermally isolated from air and moisture in the weep channels, the separator (56) also including a pair of legs (58) extending along the opposite sides of the boss (36) and turning outwardly at their extreme ends so as to cover the front of the frame member (34).

8. A frame system (22) for a wall construction system including a plurality of wall panels (24) supported in place by the frame system (22), the frame system (22) comprising:

a frame member (34) for providing structural support for the frame system (22), the frame member (34) being located behind the position of the wall panels (24);

a boss (36) formed on the frame member (34) and extending forwardly therefrom, the boss (36) having a receptacle (38) formed in it;

an exterior plate (40) attached to the boss (36) on the frame member (34) to hold a wall panel (24) between the plate (40) and the frame member (34) on either side of the boss (36), the exterior plate (40) having at least one centrally located fastener hole (44) formed in it and having eccentrically located weep holes (54) formed in it, the exterior plate (40) being adapted to hold the wall panels (24) against the frame member (34) so as to define weep channels between the edges of the wall panels (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34), the threaded fastener (42) provided with a molded covering about its head (64) of low-heat conductive material so that it does not serve to conduct heat from the boss (36) to the exterior air, the molded head (64) on the fastener (42) also including a pilot shaft (66) extending down the shaft of the fastener (42) so that the metallic shaft of the fastener (42) is not in contact with the exterior plate (40) as it passes through the hole (44) in the plate (40); and a separator (56) formed of low-heat conducting material shaped so as to fit over the boss (36) on the frame member (34), the separator (56) being adapted to be held between the exterior plate (40) and the boss (36) and completely covering the boss (36) so that the boss (36) and the frame member (34) are thermally isolated from air and moisture in the weep channels.

9. A frame system (22) for a wall construction system including a plurality of wall panels (24) supported in place by the frame system (22), the frame system (22) comprising:

a frame member (34) for providing structural support for the frame system (22), the frame member (34) being located behind the position of the wall panels (24);

a boss (36) formed on the frame member (34) and extending forwardly therefrom, the boss (36) having a receptacle (38) formed in it;

an exterior plate (40) attached to the boss (36) on the frame member (34) to hold a wall panel (24) between the plate (40) and the frame member (34) on either side of the boss (36), the exterior plate (40) having at least one centrally located fastener hole (44) formed in it and having eccentrically located weep holes (54) formed in it, the exterior plate (40) being adapted to hold the wall panels (24) against the frame member (34) so as to define weep channels between the edges of the wall panels (24) and the boss (36) on the frame member (34);

a threaded fastener (42) extending through the fastener hole (44) in the exterior plate (40) and threaded into the receptacle (38) in the boss (36) to fasten the exterior plate (40) to the frame member (34); and a separator (56) formed of low-heat conducting material shaped so as to fit over the boss (36) on the frame member (34), the separator (56) being adapted to be held between the exterior plate (40) and the boss (36) and completely covering the boss (36) so that the boss (36) and the frame member (34) are thermally isolated from air and moisture in the weep channels, the separator (56) also including a pair of legs (58) extending along the opposite sides of the boss (36) and turning outwardly at their extreme ends so as to cover the front of the frame member (34).

* * * * *